US005676007A

United States Patent [19]

Köstermeier

[11] Patent Number: 5,676,007

[45] Date of Patent: Oct. 14, 1997

[54] FLOW-FORMING-MACHINE

[75] Inventor: Karl-Heinz Köstermeier, Rietberg, Germany

[73] Assignee: Leifeld GmbH & Co., Ahlen/Westf., Germany

[21] Appl. No.: 600,826

[22] Filed: Feb. 13, 1996

[51] Int. Cl.[6] ..... B21D 22/16

[52] U.S. Cl. ..... 72/96; 72/85

[58] Field of Search ..... 72/85, 96, 110

[56] References Cited

U.S. PATENT DOCUMENTS

| | | | |
|---|---|---|---|
| 2,330,811 | 10/1943 | Darner et al. | 72/96 |
| 4,747,286 | 5/1988 | Berstein et al. | 72/110 |
| 5,125,251 | 6/1992 | Pettersson et al. | 72/96 |
| 5,323,630 | 6/1994 | Wenzel et al. | 72/96 |

FOREIGN PATENT DOCUMENTS

| | | |
|---|---|---|
| 0 61 612 | 10/1982 | European Pat. Off. . |
| 0 394 531 | 10/1990 | European Pat. Off. . |
| 0 558 815 | 9/1993 | European Pat. Off. . |

*Primary Examiner*—Lowell A. Larson
*Attorney, Agent, or Firm*—Reid & Priest L.L.P.

[57] ABSTRACT

In a flow-forming-machine having a rotatable spindle, a rotary drive for the spindle, and a pressure tool fitted to one of the spindle end faces, an axially movable counterpressure support for a workpiece is placed on the pressure tool, the counterpressure support being axially aligned with the spindle and having opposed sides. At least two rotatable pressure rollers are movably guided on a machine frame in a radial direction with respect to the spindle, while a pivot arm is provided on both the sides of the spindle and/or the counterpressure support. Each pivot arm is pivotal around an axis parallel to the longitudinal axis of the spindle by means of a powered drive. At least two pressure rollers are adjustably located on each pivot arm, and one of the pressure rollers is selectively positionable in an operable position and fixable at will for each pivot arm. The spindle together with the rotary drive and the counterpressure support are movable in the axial direction of the spindle relative to the machine frame and to the pressure rollers for executing a forming operation. The pivot arms are "L"-shaped when viewed in the longitudinal direction of the spindle, with the pivotal axis respectively lying at the free end of the short shank of the "L", the powered drive respectively engaging with the free end of the long shank of the "L" and the pressure rollers being arranged in the run of the long shank of the "L". The spindle and the counterpressure support are made in mirror image symmetry.

22 Claims, 2 Drawing Sheets

FLOW-FORMING-MACHINE

BACKGROUND OF THE INVENTION

The invention relates to a flow-forming-machine comprising a machine frame, a rotatable spindle, a rotary drive for the spindle, a pressure tool fitted to an end face of the spindle, an axially movable counterpressure support axially aligned with the spindle for a workpiece placed upon the pressure tool, at least two rotatable pressure rollers, which are movably guided in or on the machine frame in the radial direction to the spindle, whereby the spindle together with its rotary drive and the counterpressure support can be moved in the axial direction of the spindle relative to the machine frame and to the pressure rollers for executing a flow-forming operation.

A flow-forming-machine of this type is disclosed in EP 0 61 612 A1. As far as this disclosed flow-forming-machine is concerned, the main spindle together with the forming tool and the workpiece starting blank, and together with its rotary drive and the counterpressure support, are moved forward in the axial direction of the spindle during the forming operation, for which the pressure rollers are brought into engagement with the circumference of the workpiece blank by adjustment in the radial direction of the spindle until the forming operation is accomplished, in other words, until the workpiece blank is formed into the shape of the workpiece. In so doing, the pressure rollers do not need to move in the axial direction of the spindle and only move out again in the radial direction of the spindle upon completion of the forming operation. Conventionally, two or three pressure rollers are distributed uniformly over the circumference of the spindle, the pressure rollers being preferably located in a non-movable frame, non-movable in the axial direction of the spindle. Only guides are then required for the pressure rollers, providing just a single direction of movement, namely in the radial direction of the spindle. In this case, these guides are linear guides, which enable movement of the pressure rollers in the radial direction of the spindle relative to the rigid frame supporting the pressure rollers.

An aspect regarded to be disadvantageous for the disclosed flow-forming-machine is that it is only possible by means of considerable constructive effort to design the frame supporting the pressure rollers in a manner, such that high compression forces may be exerted upon the workpiece by the pressure rollers, without undesirable deformative flexure of the frame occurring, causing uncontrollable deviations of positioning of the pressure roller relative to the spindle and to the workpiece.

An arrangement is disclosed in EP 0 558 815 A1 for producing a profiled hollow workpiece, profiled straight or at an angle to the workpiece axis, at least internally. This arrangement is per se a known cold-rolling machine, which has adjustable roller head carriers, movable away from the workpiece and towards the workpiece, having rotational drivable roller heads therein, wherein engagement rollers are located in the roller heads, which can execute separate rolling operations on a workpiece situated on a mandrel revolving on a circular path whilst the roller heads are rotating. In addition, a pressure roller is mounted in each case on the roller head carriers on this cold-rolling machine to freely rotate without being driven on a roller axis/shaft tilted at an angle or parallel to the mandrel axis and located outside the circular path of the engagement roller. Even for this arrangement, the roller head carriers with the pressure rollers located thereon are adjustable/movable radially in two counteropposed directions to one another in relation to the spindle by means of linear guides. At the same time, the spindle is movable with the workpiece in its longitudinal direction.

An aspect regarded to be disadvantageous for this disclosed arrangement is that it can only be used for a very special purpose of application, and offers little scope regarding its use for producing a diversity of workpieces.

Finally, a folding machine is disclosed in EP 0 394 531 B1, which is used to produce a folded seam connection along with the joint between two part shells made of sheet metal, for example shell sound absorbers, provided with folded flanges. On this folding machine, the folding tool is represented by at least one folding roller, which is located on the free end of a folding arm on a shaft, to enable its rotation, running parallel to the axis of rotation of the workpiece at the height of the folded flange. In so doing, the folding arm is pivotal around an axis running parallel to the axis of rotation of the workpiece, outside the zone of rotation of the workpiece and can make its engagement by contact pressure in the direction towards the folded flange. A further provision of this disclosed folding machine is that a guide roller is located on the free end of the folding arm for the folding roller, offset at least in its axial direction, which is also rotatable around an axis running parallel to the axis of rotation of the workpiece, and which runs during the folded operation over a flat or curved guide face, which is formed as part of a workpiece fixture. At least one piston/cylinder unit is provided for generating the contact pressure of the folding arm.

As aspect regarded to be disadvantageous for this disclosed folding machine is that it is restricted with respect to its possibilities of use for producing folded joints. Forming operations on workpieces purely by the application of flow forming or spinning alone cannot be undertaken on this known machine. Furthermore, as a disadvantage, a flat or curved guide face is required, resulting in increased constructive effort, and which makes conversions of the machine very expensive for accommodating any changes or modifications to the workpiece to be accomplished on the machine.

SUMMARY OF THE INVENTION

As a result, it is an object of the invention to create a flow-forming-machine of the type mentioned in the preamble, which obviates the aforementioned disadvantages and, in particular, can, with less constructive effort and outlay, be versatile in it application and can be cost-effectively operated, and with which, at the same time, workpieces can be produced having a high production quality and dimensional accuracy.

This object is solved by means of a flow-forming-machine of the aforementioned type, wherein

- a pivot arm is provided on both sides of the spindle and/or counterpressure support in each instance, and is made pivotal by means of a powered drive system around an axis parallel to the longitudinal axis of the spindle,
- each pivot arm carries at least two pressure rollers and
- the pressure rollers are adjustably located on each pivot arm, whereby for each pivot arm one of the pressure rollers can be positioned in an operable position and as the case may be, fixed as determined by choice.

Due to the locations of the pressure rollers on the pivot arms according to the invention, an extremely simple, trouble-free and, at the same time, very stable fabricative setup is feasible, which only characterizes very low levels of deformative flexural yield when one or two of the pressure rollers are brought into engagement with the workpiece. At the same time, a fulcrum bearing for the pivot of the pivot arms is far less costly and simpler to produce than a linear guide for accomplishing high compression forces. After all, the use of pivot arms offers the opportunity of utilizing lever gearing, so that large compression forces can be generated by the adoption of relatively small powered drives, provided the lever arms are appropriately selected. Finally, it is feasible and advantageous to fit two or even more pressure rollers, as the case may be, to each of the two pivot arms, so that selection can be made from a relatively large number of pressure rollers, whereby the switching over from one pressure roller to another pressure roller, which needs to be brought into engagement with the workpiece, can be accomplished extremely swiftly. In this way, the flow-forming-machine in accordance with the invention can be re-tooled very rapidly, and can be adapted to suit various forming and forming tasks, involving minimal cost in time.

An advantageous embodiment of the flow-forming-machine in accordance with the invention is provided by the fact that the two pivot arms are pivotal around a common axis. This measure represents a further contribution in the endeavors to create a machine of the most simple constructional design possible.

A further embodiment of the invention is characterized by the fact that the pressure rollers can be rotated around an axis parallel to the longitudinal axis of the spindle, and that the rotational axis of the pressure roller(s), situated in the operable position at any one time, and the longitudinal axis of the spindle, lie on a common radius around the associated or pivotal axis of the pivot arm(s) in each case. This embodiment offers, more especially, the advantage that any changes which need to be made to the control parameters or the stored program data, as a result of any physical reworking of the pressure rollers, which inevitably mean a reduction in their diameter, are particularly simple to effect, since the amount of correction merely involves linear adjustment to the radius of the pressure rollers. This simple linear relationship is a result of the fact that the angle between the longitudinal axis of the spindle and the rotational axis of the pressure roller, when measured from the pivotal axis of the pivot arms, is relatively small, and, the contact zone, therefore, between the workpiece rotating with the spindle on the one hand, and the pressure roller working with the workpiece on the other hand, still lies, to a large extent, on a common radius. Consequently, the flow-forming-machine in accordance with the invention can be recommissioned back into service again following the re-machining of the pressure roller as a result of wear, without any variations occurring in the production of the products produced prior to, and subsequent to the reworking operation, and without having to prepare lengthy calculations for correction.

Furthermore, it is preferable for the pivot arms to be "L"-shaped as viewed in the longitudinal direction of the spindle, whereby the pivotal axis, in each instance, lies at the free end of the short shank of the "L", whereby the powered drive engages, in each instance, on the free end of the long shank of the "L" and whereby the pressure rollers are arranged in the run of the long shank of the "L". This design of the pivot arms imparts a high degree of stability and good resistance to deformation, whilst, at the same time, occupying relatively little space. In addition, this enables the utilization of lever gearing, thus increasing the pressure forces able to be generated.

The aforementioned powered drives of the pivot arms are preferably formed by controlled linearly adjustable/movable ball-roller-spindles or hydraulic piston/cylinder units, which act upon the pivot arm at one end, and at the other end are supported on the machine frame in each instance. It is because of these known powered drives per se that, firstly, the forces needed are imparted, and secondly, a high degree of accuracy in the positioning of the pivot arms, and thus to the pressure rollers relative to the workpiece, is assured.

In order to hold the above stated plurality of pressure rollers for each pivot arm against these arms, and to maintain the free choice of selection for engagement with the workpiece, it is preferred to provide on each pivot arm a linearly movable or pivotal pressure roller carrier, which can be adjustable/movable between at least two positions relative to the pivot arm.

A further embodiment of the last stated design of the flow-forming-machine proposes that the pressure roller carrier be movable on a guide provided on the pivot arm at a plane, running essentially vertical to the longitudinal axis of the spindle between two end stops and can be fixed in its position at the end stops. In this arrangement of the flow-forming-machine, two pressure rollers can be held at the ready, wherein the prime advantage of this design lies in the fact that a pressure roller can be switched speedily in respect to others for engagement with the workpiece and, at the same time, accurately, because only a linear sliding movement is required up to the end stops, which have preferably been pre-set for this purpose.

An alternative embodiment of the flow-forming-machine provides for the pressure roller carrier to be rotatable around a pivotal axis provided on the pivot arm, basically running parallel to the longitudinal axis of the spindle between at least two positions of rotation, and which can be fixed in the desired positions of rotation. This design also permits the standby of at least two, preferably a larger number of pressure rollers, e.g. six pressure rollers for each pressure roller carrier. In this arrangement the pressure roller carrier is formed as a tool turret, with which by rotation the desired pressure roller can be brought into the operating position. As a result, this arrangement of the flow-forming-machine offers, in particular, the possibility of having a large number of pressure rollers ready at hand, for example, twelve pressure rollers, without the necessity of carrying out fitting operations in respect of the pressure rollers needing to be dismantled and installed.

In addition, the invention proposes that the spindle and the counterpressure support are designed symmetrically and that the counterpressure support has its own rotary drive and its own axial drive. This design of the flow-forming-machine offers the advantage that the spindle and the counterpressure support can generally be made as almost identical assemblies, keeping, despite two rotary drives and two axial drives, manufacturing costs to a minimum. In addition, the flow-forming-machine can, in this way, be used in service to a high degree of versatility, because pressing operations or forming operations can be executed equally well in each of the two axial directions of the spindle. Consequently, workpieces can, for example, be processed in a single clamping and processing operation in which forming is effected through pressing in two counter-opposing axial directions. This saves production time and thus production costs.

A further embodiment of the last stated design of the flow-forming-machine proposes that the rotary drives of the spindle and counterpressure support and the axial drives of the spindle and counterpressure support can be operated independently of each other or in synchronization with one another as required in each case.

Advantage is thereby attained in that the spindle and the counterpressure support, depending on the operational step to be carried out, either execute movements independently of each other or behave as a single operational unit of the machine.

Finally, it is further proposed that a loading mechanism is arranged for the feeding of workpiece blanks and for the discharging of processed workpieces into a machine zone at a distance away from the pivot arms as viewed in the longitudinal direction of the spindle. By the means of such a type of loading mechanism, automatic feeding of workpiece blanks and automatic discharging of processed workpieces is possible, whereby, at the same time, because of the axial motion of the spindle and the counterpressure support, the loading operation can be carried out at any point without further ado where it is not hindered by the pivot arms and the pressure rollers held therein. As a result, the loading mechanism can be kept relatively simple in design, because the workpiece blanks and/or finished workpieces merely have to be manipulated and moved in the radial direction relative to the spindle. The axial movements in the direction of the spindle, necessary for the loading of the flow-forming-machine, can be carried out by the said spindle itself and by the counterpressure support.

BRIEF DESCRIPTION OF THE DRAWINGS

A preferred embodiment of the flow-forming-machine in accordance with the invention is further explained in the following description with regard to a drawing. The figures of the drawing depict in.

DESCRIPTION OF THE PREFERRED EMBODIMENT

Figure 1:
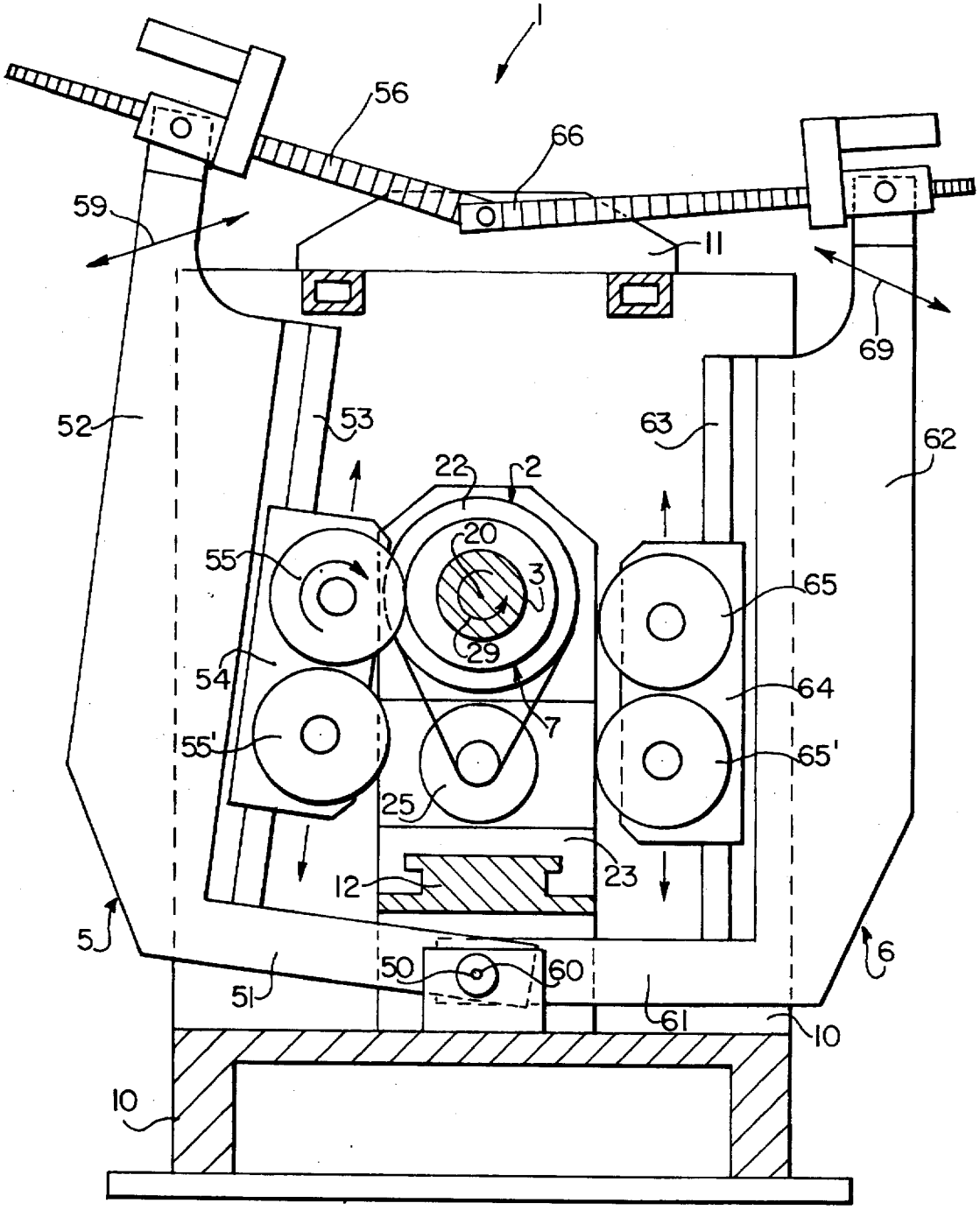
FIG. 1 a flow-forming-machine in schematic presentation in an end view, partly in cross section and FIG. 2 a flow-forming-machine in schematic presentation in plan view.

As FIG. 1 of the drawing depicts, the depicted design example here of the flow-forming-machine 1 has a load-bearing machine frame 10, from which a frame face section 11 extends upwards at the rear.

In the center of the flow-forming-machine 1 is arranged a spindle 2, the fulcrum axis 20 of which runs vertical to the plane of the drawing. The spindle 2 is fitted together with a spindle rotary drive 25 on a spindle carriage 23. This spindle carriage 23 is movable along a guide 12 forming part of the machine frame 10 parallel to the rotational axis of the spindle 20, an associated spindle axial drive not being pictorially illustrated here. The transmission of angular torque to the spindle 2 is effected by the rotary drive 25 by means of a belt drive, for example a multiplex belt drive, to a pulley 22 forming a part of the spindle. The spindle 2 supports a non-illustrated forming tool, on which is held, for example, a rotationally symmetrical workpiece 7, which workpiece 7 is cup-shaped or cylindrically hollow (like a bushing) in its basic form. The workpiece 7 is fixed in its position on the forming tool by a counterpressure support 3, which is shown here in section. The counterpressure support 3 can be rotated around an axis aligned with the rotational axis of the spindle 20 and can also be moved in the axial direction of the spindle.

Furthermore, according to FIG. 1, the flow-forming-machine 1 has two pivot arms 5, 6, which are fitted on both sides of the spindle 2 and which can be pivoted by a certain angular amount around respective common pivotal axes 50, 60 running parallel to, and beneath the rotational axis 20 of the spindle. The two pivot arms 5, 6 are shown "L"-shaped in the view depicted in FIG. 1. The short shanks 51, 61 of the "L" run horizontally or almost horizontally to the left and to the right from the pivotal axes 50, 60; the long shanks 52, 62 run vertically or almost vertically. Respective powered drives 56, 66 are provided for each pivot arm for pivoting the pivot arms 5, 6. These powered drives 56, 66 are designed here as ball-roller spindles, which on one end are supported by the frame face section 11 of the machine frame 10, and on the other end, act upon the free end of the long shanks 52, 62 of the "L" of the pivot arms 5, 6. By operating the powered drives 56, 66, pivotal movement of the pivot arms 5, 6 around their pivotal axes 50, 60 in the direction of the arrows 59, 69 is possible.

On their sides, facing the spindle 2, the long shanks 52, 62 of the "L" of the two pivot arms 5, 6 carry respective roller carriages, 54, 64 which can be moved along respective linear guides 53, 63 in the longitudinal direction as the case may be. In the depicted design example, each of roller carriages 54, 64 carries two pressure rollers 55, 55' or 65, 65', respectively, which are located to rotate around the axes running parallel to the rotational axis 20 of the spindle.

In the design state shown in FIG. 1 of the flow-forming-machine 1, the left hand pivot arm 5 is pivoted by the operation of the powered drive 56 in the direction towards the spindle 2, whereby the pressure roller 55 located on the roller carriage 54 is brought into contact with the outer circumference of the workpiece 7. By means of further axial movement of the spindle 2 along the guide 12, a forming operation can be effected for forming the workpiece 7, whereby the workpiece 7 rotates together with spindle 2 in the direction of the arrow of rotation 29 around its center axis.

If required, two pressure rollers may be brought into engagement at the same time, whereby both pivot arms 5, 6 pivot away simultaneously in the direction towards spindle 2, thus bringing the two required pressure rollers into operation. In addition, exchanging the pressure roller in engagement with the workpiece 7 can be accomplished with each at any time, such that after pivoting away the respective pivot arm 5 or 6, the associated roller carriage 54 or 64 is moved along its guide 53 or 63 by an appropriate distance. This movement of the roller carriage 54 or 64 is preferably effected against fixed stops, which are not actually depicted on the drawing. The roller carriages 54, 64, can, for example, be actuated by means of hydraulic piston cylinder units, which are also not depicted on the drawing.

Figure 2:
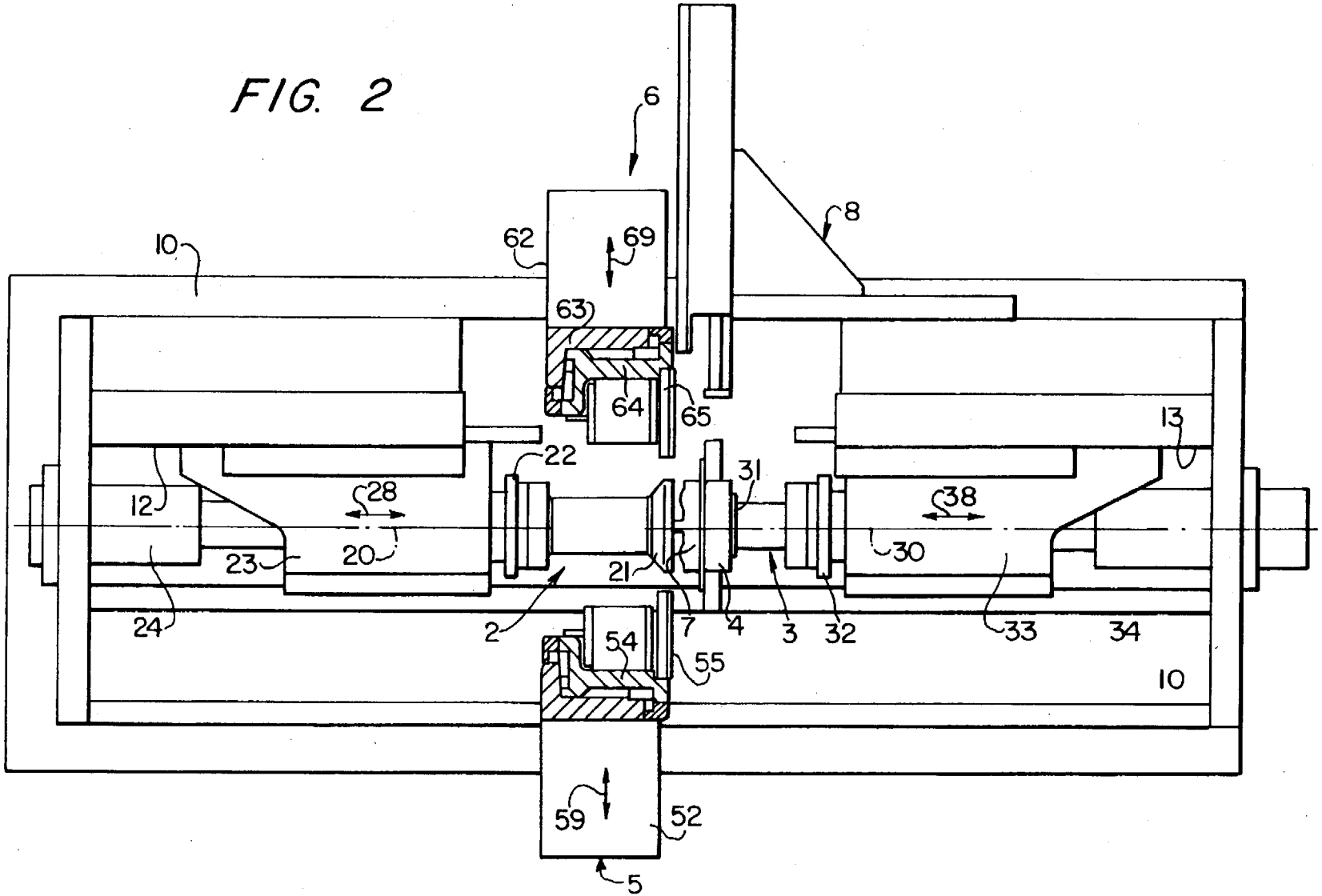

FIG. 2 of the drawing shows a flow-forming-machine 1 in plan view, whereby the load bearing part of the flow-forming-machine 1 is formed once again by the machine frame 10. On the left hand section of the flow-forming-machine 1 is arranged the spindle 2, which can be moved together with its rotary drive on the spindle carriage 23 as depicted by the arrow of movement 28 in the direction of the rotational axis 20 of the spindle. This movement is imparted by an axial drive 24 of the spindle on the left-hand end of the flow-forming-machine 1.

In an essentially symmetrical structure on the right-hand section of the flow-forming-machine is arranged the counterpressure support 3, which also features its own rotary drive and a counterpressure support carriage 33. The counterpressure support 3 is movable as a whole in the axial direction 38 by means of the counterpressure support carriage 33 along the rotational axis 30 of the counterpressure support, which aligns with the rotational axis 20 of the spindle, for which an axial drive 34 of the counterpressure support is provided on the right-hand end of the flow-forming-machine 1. In so doing, spindle 2 with its spindle carriage 23 can move along the guide 12, forming a part of the machine frame 10; the counterpressure support 3 can be moved with its counterpressure support carriage 33 on a guide 13 also forming a part of the machine frame 10.

At the end face 31 of the counterpressure support 3 is arranged the forming tool 4, whereby it is of little consequence whether the forming tool 4 is fitted to the end face 31 of the counterpressure support 3 or to the end face 21 of the spindle 2, due to the design of spindle 2 and that of the counterpressure support 3 being symmetrical. The mounting of this forming tool depends solely upon the requirements of each individual situation and can thus be determined by the technician. Two forming tools can also be used simultaneously, one on the spindle 2 and one on the counterpressure support 3.

On either side of the spindle 2, as shown in FIG. 1, that is, above and below the spindle 2 as shown in FIG. 2, can respectively be seen in partial cross section the two pivot arms 5, 6, wherein the long shanks 52, 62 of the "L" lie to the outside in each instance. On their sides facing the spindle 2, the "L" shanks 52, 62 carry in each case the guides 53, 63 for the associated roller carriages 54, 64. Once again pressure rollers are located on the latter, which can rotate, the respective upper pressure rollers 55, 65 being clearly visible. By operating the non-illustrated powered drive, lying above the plane of the drawing, the pivot arms 5, 6 can be pivoted in the direction of the arrows of movement 59, 69 and thus move the pressure rollers 55, 65 relative to the spindle 2 in a plane perpendicular to their rotational axis 20.

Between the forming tool 4 and the end face 21 of the spindle 2 is depicted an already processed workpiece 7, which can be removed from the flow-forming-machine 1. A loading mechanism 8 is provided here, as is already conventional for flow-forming-machines, for loading the flow-forming-machine 1 with workpiece blanks and for removing the finished workpiece 7. By means of this loading mechanism 8, the already processed workpiece 7 can be grasped on its external circumference and, in a plane perpendicular to the rotational axis 20 of the spindle 2 and to the rotational axis 30 of the counterpressure support 3, can be transported outwards away from the position depicted in FIG. 2. In the opposite direction, the workpiece blank can then be positioned between the pressure tool 4 and the end face 21 of the spindle 2, and be fixed by moving the spindle 2 and the counterpressure support 3 together in the direction of the arrows 28, 38. In so doing, there is no chance of collision or spatial overlap/occupancy of, on the one hand, the loading mechanism 8 or of, on the other hand, the pivot arms 5, 6 as a consequence of any axial motion of the spindle 2 and the counterpressure support 3.

It is to be understood that although a preferred embodiment of the invention has been described, various other embodiments and variations may occur to those skilled in the art. Any such other embodiments and variations which fall within the scope and spirit of the present invention are intended to be covered by the following claims.

What we claim is:

1. A flow-forming machine comprising:

a machine frame;

a rotatable spindle having a longitudinal axis, opposed end faces, and opposed sides;

a rotary drive for the spindle;

a pressure tool fitted to one of the spindle end faces;

an axially movable counterpressure support for a workpiece placed on the pressure tool, the counterpressure support being axially aligned with the spindle and having opposed sides;

at least two rotatable pressure rollers movably guided on the machine frame in a radial direction with respect to the spindle;

a pivot arm provided on both the sides of at least one of the spindle and the counterpressure support, each said pivot arm being "L"-shaped when viewed in the longitudinal direction of the spindle and having a short shank and a long shank, the short shank and the long shank each having a free end, and each the pivot arm being pivotable around a pivot axis parallel to the longitudinal axis of the spindle, the pivot axis of each said pivot arm being placed at the free end of the short shank of the pivot arm and pivotably supporting the pivot arm, the pivot arms being pivotable independently of one another;

at least two pressure rollers adjustably located on each the pivot arm, one of the pressure rollers being selectively positionable in an operable position and fixable at will for each the pivot arm;

a rotatable pressure roller carrier movably arranged in the run of the long shank of each said pivot arm, the pressure roller carrier rotatably carrying the at least two pressure rollers; and a plurality of powered drives, one said powered drive being provided for each the pivot arm for pivoting the pivot arms independently of one another, each of the powered drives being mounted on the machine frame and engaging with the free end of the long shank of its respective pivot arm;

the spindle together with the rotary drive and the counterpressure support being movable in the axial direction of the spindle relative to the machine frame and to the pressure rollers for executing a forming operation.

2. A flow-forming-machine as claimed in claim 1, wherein the pivot arms are pivotable around a common axis.

3. A flow-forming-machine as claimed in claim 2, wherein the pressure rollers are rotatable around rotational axes parallel to the longitudinal axis of the spindle, and wherein the rotational axis of the pressure rollers positioned in the operable position and the longitudinal axis of the spindle lie on a common radius around the common pivot axis of the pivot arms.

4. A flow-forming-machine as claimed in claim 1, wherein the powered drives of the pivot arms comprise controlled linearly movable hydraulic piston cylinder units, which engage with the pivot arms at one end and, at the other end, are supported on the machine frame.

5. A flow-forming-machine as claimed in claim 1, wherein each said rotatable pressure roller carrier is movable between at least two positions relative to the pivot arms.

6. A flow-forming-machine as claimed in claim 5, further comprising a guide, running generally perpendicular to the longitudinal axis of the spindle, provided on the pivot arm, and two end stops provided on the guide, and wherein the pressure roller carrier is movable on the guide between the two end stops and can be fixed in its position at the end stops.

7. A flow-forming-machine as claimed in claim 5, wherein the pressure roller carrier is pivotable around a rotational axis, running generally parallel to the longitudinal axis of the spindle between at least two positions of rotation and can be selectively fixed in any one of the positions of rotation.

8. A flow-forming-machine as claimed in claim 1, wherein the spindle and the counterpressure support are made in mirror image symmetry, and further comprising a separate rotary drive and axial drive drivingly connected to the counterpressure support.

9. A flow-forming-machine as claimed in claim 8, wherein the rotary drives of the spindle and the counterpressure support and the axial drives of the spindle and the counterpressure support are selectively operable in a first mode in which they operate independently of one another and in a second mode in which they operate in synchronization with one another.

10. A flow-forming-machine as claimed in claim 1, further comprising a loading mechanism for the feeding of workpiece blanks and the discharging of processed workpieces arranged in a machine zone at a distance away from the pivot arms when viewed in the longitudinal direction of the spindle.

11. A flow-forming-machine as claimed in claim 1, wherein the pressure rollers are rotatable around rotational axes parallel to the longitudinal axis of the spindle, and wherein the rotational axis of the pressure rollers positioned in the operable position and the longitudinal axis of the spindle lie on a common radius around the pivot axis of the respective associated pivot arms.

12. A flow-forming-machine as claimed in claim 1, wherein the powered drives of the pivot arms comprise controlled linearly movable ball-roller-spindles, which engage with the pivot arms at one end, and, at the other end, are supported on the machine frame.

13. A flow-forming machine comprising:

a machine frame;

a rotatable spindle having a longitudinal axis, opposed end faces, and opposed sides;

a rotary drive for the spindle;

a pressure tool fitted to one of the spindle end faces;

an axially movable counterpressure support for a workpiece placed on the pressure tool, the counterpressure support being axially aligned with the spindle and having opposed sides;

at least two rotatable pressure rollers movably guided on the machine frame in a radial direction with respect to the spindle;

a pivot arm provided on both the sides of at least one of the spindle and the counterpressure support, each the pivot arm having first and second free ends, and each the pivot arm being pivotable around a pivot axis parallel to the longitudinal axis of the spindle, the pivot axis of each the pivot arm being placed at the first free end and pivotably supporting the pivot arm, the pivot arms being pivotable independently of one another;

at least two pressure rollers adjustably located on each the pivot arm, one of the pressure rollers being selectively positionable in an operable position and fixable at will for each the pivot arm;

a rotatable pressure roller carrier movably arranged on each the pivot arm remote from the first free end, the pressure roller carrier rotatably carrying the at least two pressure rollers; and a plurality of powered drives, one said powered drive being provided for each said pivot arm for pivoting the pivot arms independently of one another, each of the powered drives being mounted on the machine frame and engaging with the second free end of its respective pivot arm;

the spindle together with the rotary drive and the counterpressure support being movable in the axial direction of the spindle relative to the machine frame and to the pressure rollers for executing a forming operation.

14. A flow-forming-machine as claimed in claim 13, wherein the pivot arms are pivotable around a common axis.

15. A flow-forming-machine as claimed in claim 14, wherein the pressure rollers are rotatable around rotational axes parallel to the longitudinal axis of the spindle, and wherein the rotational axis of the pressure rollers positioned in the operable position and the longitudinal axis of the spindle lie on a common radius around the common pivot axis of the pivot arms.

16. A flow-forming-machine as claimed in claim 13, wherein the powered drives of the pivot arms comprise controlled linearly movable hydraulic piston cylinder units, which engage with the pivot arms at one end and, at the other end, are supported on the machine frame.

17. A flow-forming-machine as claimed in claim 16, wherein each said rotatable pressure roller carrier is movable between at least two positions relative to the pivot arms.

18. A flow-forming-machine as claimed in claim 17, further comprising a guide, running generally perpendicular to the longitudinal axis of the spindle, provided on the pivot arm, and two end stops provided on the guide, and wherein the pressure roller carrier is movable on the guide between the two end stops and can be fixed in its position at the end stops.

19. A flow-forming-machine as claimed in claim 17, wherein the pressure roller carrier is pivotable around a rotational axis, running generally parallel to the longitudinal axis of the spindle between at least two positions of rotation and can be selectively fixed in any one of the positions of rotation.

20. A flow-forming-machine as claimed in claim 13, wherein the spindle and the counterpressure support are made in mirror image symmetry, and further comprising a separate rotary drive and axial drive drivingly connected to the counterpressure support.

21. A flow-forming-machine as claimed in claim 20, wherein the rotary drives of the spindle and the counterpressure support and the axial drives of the spindle and counterpressure support are selectively operable in a first mode in which they operate independently of one another and in a second mode in which they operate in synchronization with one another.

22. A flow-forming-machine as claimed in claim 13, further comprising a loading mechanism for the feeding of workpiece blanks and the discharging of processed workpiece arranged in a machine zone at a distance away from the pivot arms when viewed in the longitudinal direction of the spindle.

* * * * *